United States Patent [19]

Moore

[11] 4,295,796

[45] Oct. 20, 1981

[54] GAS LIFT APPARATUS

[75] Inventor: Howard H. Moore, Houston, Tex.

[73] Assignee: McMurry/Hughes, Inc., Huntsville, Tex.

[21] Appl. No.: 53,302

[22] Filed: Jun. 29, 1979

[51] Int. Cl.[3] ..... F04F 1/20

[52] U.S. Cl. ..... 417/115; 137/155; 166/117.5

[58] Field of Search ..... 137/155; 417/108, 109, 417/115; 166/117 S

[56] References Cited

U.S. PATENT DOCUMENTS

| | | | |
|---|---|---|---|
| 2,210,247 | 8/1940 | Kyner | 417/115 |
| 2,342,301 | 2/1944 | Peters | 137/155 |
| 2,385,316 | 9/1945 | Walton | 137/155 |
| 2,465,060 | 3/1949 | Carlisle et al. | 137/155 |
| 2,620,740 | 12/1952 | Garrett et al. | 137/155 |
| 2,806,429 | 9/1957 | Anderson et al. | 137/155 |
| 2,824,525 | 2/1958 | McGowen | 166/117.5 |
| 2,963,036 | 12/1960 | Surles | 137/155 |
| 3,143,128 | 8/1964 | Bicking | 137/155 |
| 3,741,299 | 6/1973 | Terral | 166/117.5 |
| 3,874,445 | 4/1975 | Terral | 166/117.5 |
| 3,889,748 | 6/1975 | Tausch | 166/117.5 |
| 4,239,082 | 12/1980 | Terral | 166/117.5 |

*Primary Examiner*—Chris K. Moore

*Attorney, Agent, or Firm*—Robert A. Felsman; E. Richard Zamecki

[57] ABSTRACT

The invention comprises gas lift apparatus including a generally tubular mandrel defining a main longitudinal bore therethrough and including pocket walls defining a longitudinally extending pocket laterally offset from the main bore and generally divided therefrom. The pocket has an open upper end for insertion of a gas lift valve. The pocket walls further have ports extending laterally therethrough on both sides of pocket, i.e. between the pocket and the main bore of the mandrel and between the pocket and the exterior of the mandrel. On one side of the pocket there are at least two such ports longitudinally spaced from each other, and on the other side of the pocket there is at least one port disposed longitudinally between the aforementioned pair of ports. The invention further comprises a gas lift valve adapted to be received in the pocket, and when so received, operable to permit communication between the port or ports on one side of the pocket and the port or ports on the other side of the pocket.

18 Claims, 13 Drawing Figures

FIG. 1
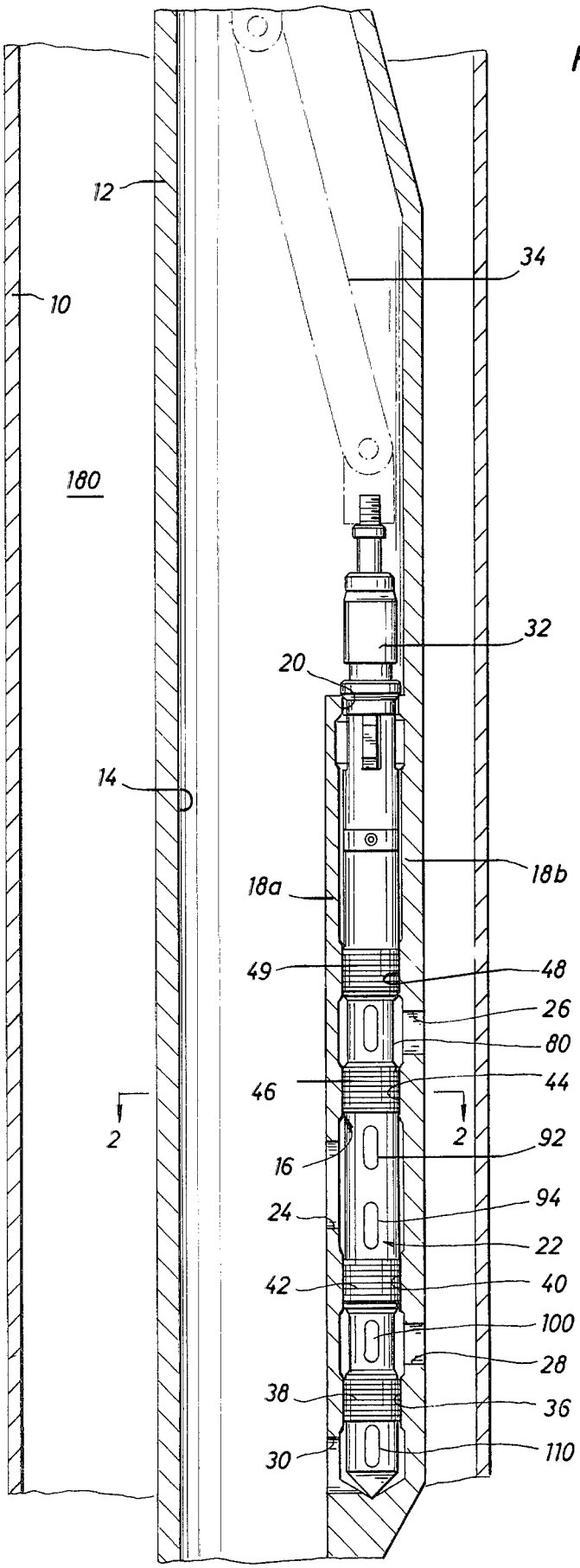
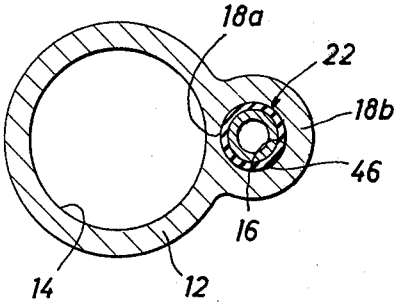
FIG. 2

GAS LIFT APPARATUS

BACKGROUND OF THE INVENTION

1. Field of the Invention

The present invention pertains to gas lift apparatus and more specifically to side pocket mandrels and gas lift valves for disposition therein. The purpose and function of gas lift valves generally is well known in the art and will not be described in great detail herein. Briefly, such apparatus is used to facilitate petroleum production in wells in which the formation pressure alone is not sufficient to force the oil to the surface. A typical production well includes a casing lining the well bore and a smaller string of production tubing suspended within the casing so as to define an annulus between the two conduits. In many instances, oil is recovered by causing it to flow upwardly through the inner string of production tubing. In other instances, the oil is caused to flow upwardly through the annulus between the tubing and casing. In any event, assuming that the production tubing (or annulus, depending upon the technique being used) has a column of oil therein, the pressure head of such liquid column may exceed the formation pressure so that the latter cannot force the oil upwardly through the well. Of course, if the formation pressure is exceedingly low, it may be necessary to actively pump the oil from the well. However, in some instances, there is sufficient formation pressure so that, if the density of the column of oil can be reduced, the oil can be caused to flow upwardly without such pumping.

In order to so reduce the density of a column of oil in a well, gas lift valves are frequently employed. Such a valve is typically disposed in a side pocket in a special mandrel. If the oil is being recovered through the tubing, gas is pumped into the annulus. Conversely, if the oil is being recovered from the annulus, gas is pumped into the tubing. In any event, the gas lift valve permits the gas so pumped into the well to pass through the side pocket of the mandrel, which forms a part of the production tubing string, and into the column of oil. As the gas bubbles upwardly through the column, it reduces the column's density as described hereinabove.

2. Description of the Prior Art

The conventional side pocket mandrel for receipt of a gas lift valve includes only a single inlet and a single outlet, and the corresponding valve includes the same number of general ingress or egress areas. Such pockets and valves provide adequate gas flow for gas lift operations for wells in which the maximum potential production rate is low to moderate. However, since the sizes of the inlets and outlets cannot be made too large without sacrificing proper functioning of the valve in general and proper regulation of gas flow, e.g. the emission of gas into the column of oil in the form of relatively small bubbles which may be dispersed throughout the column decreasing its density, such conventional valves may not provide sufficient volume of gas flow for relatively high capacity wells, e.g. those capable of producing on the order of 50,000 barrels per day.

Past and present solutions to the problem of providing adequate flow for gas lift operations in high capacity wells have generally required an excessive number of parts and consumption of space on the production string, and have been expensive, awkward, and generally troublesome. One such prior approach has been to run a series of side pocket mandrels, each with its respective gas lift valve, immediately above one another in the production string so that there are, for example, two or three such valves operating at roughly the same depth. Another approach has been to provide a mandrel with multiple side pockets disposed about its circumference, with a separate gas lift valve in each of these pockets. It should be apparent that each of these two prior approaches suffers from the general disadvantages described hereinabove.

SUMMARY OF THE INVENTION

The present invention comprises gas lift apparatus including a generally tubular mandrel defining a main longitudinal bore therethrough and including pocket wall means defining a longitudinally extending pocket laterally offset from the main bore and generally divided therefrom. The pocket has an open upper end through which a gas lift valve may be inserted. The pocket wall means further have first port means extending laterally therethrough between the pocket and the main bore of the mandrel and second port means disposed generally on the opposite side of the pocket from the first port means and extending laterally through the pocket wall means between the pocket and the exterior of the mandrel. One of the first or second port means includes a pair of longitudinally spaced inlet ports, and the other of the first or second port means includes a primary outlet port disposed longitudinally between the inlet ports.

A valve assembly is adapted to be received in the pocket, and when so received, operable to permit communication between the port means on one side of the pocket and the port means on the other side of the pocket. Preferably, the valve permits communication between both of the aforementioned inlet ports and the primary outlet port. Accordingly, the present apparatus, while consuming little more space in the tubing string than a conventional single inlet valve and mandrel, provides multiple inlets thereby increasing the volume of gas which may be passed through the valve over a given period of time. Not only does this reduce expense by the elimination of the need for multiple valves and multiple mandrels and/or pockets to receive them, but also vastly reduces the operating time which would otherwise be consumed by inserting such multiple valves, one by one, into their respective pockets.

More specifically, the valve assembly includes a valve body having central longitudinal bore means at least partially defining a flowway extending generally lengthwise of the pocket. Lock means are cooperative between the valve body and the pocket walls to lock the valve body in a fixed position within the pocket, such lock means preferably being releaseable for subsequent removal of the valve. The valve body has a first lateral opening therethrough from the bore means and positioned to communicate with the uppermost one of the aforementioned pair of inlet ports when the valve body is in said fixed position. A second lateral opening is provided, also from the bore means, and positioned to communicate with the lower of said pair of inlets when the valve body is in such fixed position. Finally, a third lateral opening is provided from the bore means and positioned to communicate with the primary outlet port when the valve body is in its fixed position. A first valve element is movably mounted on the valve body for opening and closing the bore means, between the first and third lateral openings, and a second valve element is movably mounted on the valve body for opening and closing the bore means between the second and third lateral openings.

To provide for even further gas handling capacity, the valve body may have an open upper end registering with the upper end of the pocket, and the valve assembly may further include a third valve element movably mounted on the valve body for opening and closing the bore means between the first lateral opening and the open end of the valve body. Likewise, the port means of the pocket wall may include an auxilliary outlet port on the same side of the pocket as the primary outlet port and spaced below the primary outlet port as well as below the lower of the aforementioned pair of inlet ports. The valve body is then provided with an auxilliary opening from its bore means and positioned to communicate with such auxilliary outlet port when the valve body is in its fixed position. The valve assembly further comprises a fourth valve element movably mounted on the valve body for opening and closing the bore means between the second lateral opening and the auxilliary opening. Accordingly, such a preferred form of the invention may be capable of handling several times the gas flow which would be accommodated by typical prior gas lift valves, but without a proportionate increase in the size, installation time, etc.

The valve assembly also includes improvements in the lock assembly for releaseably fixing the valve body in the mandrel pocket.

Accordingly, it is a principal object of the present invention to provide a single side pocket mandrel and gas lift valve having multiple inlets and/or outlets.

A further object of the present invention is to provide an improved side pocket mandrel and gas lift valve assembly with increased gas handling capacities without proportional increase in size or installation time.

Still another object of the present invention is to provide an improved gas lift valve.

Yet a further object of the present invention is to provide such a valve having improved lock means for releasably fixing the valve within a side pocket mandrel.

Still other objects, features, and advantages of the present invention will be made apparent by the following detailed description of the preferred embodiments, the drawings, and the claims.

BRIEF DESCRIPTION OF THE DRAWINGS

FIG. 1 is a side view partly in section and partly in elevation of a side pocket mandrel and gas lift valve according to the present invention.

FIG. 2 is a transverse cross-sectional view taken along the line 2—2 in FIG. 1.

DESCRIPTION OF THE PREFERRED EMBODIMENT

Figure 3A:
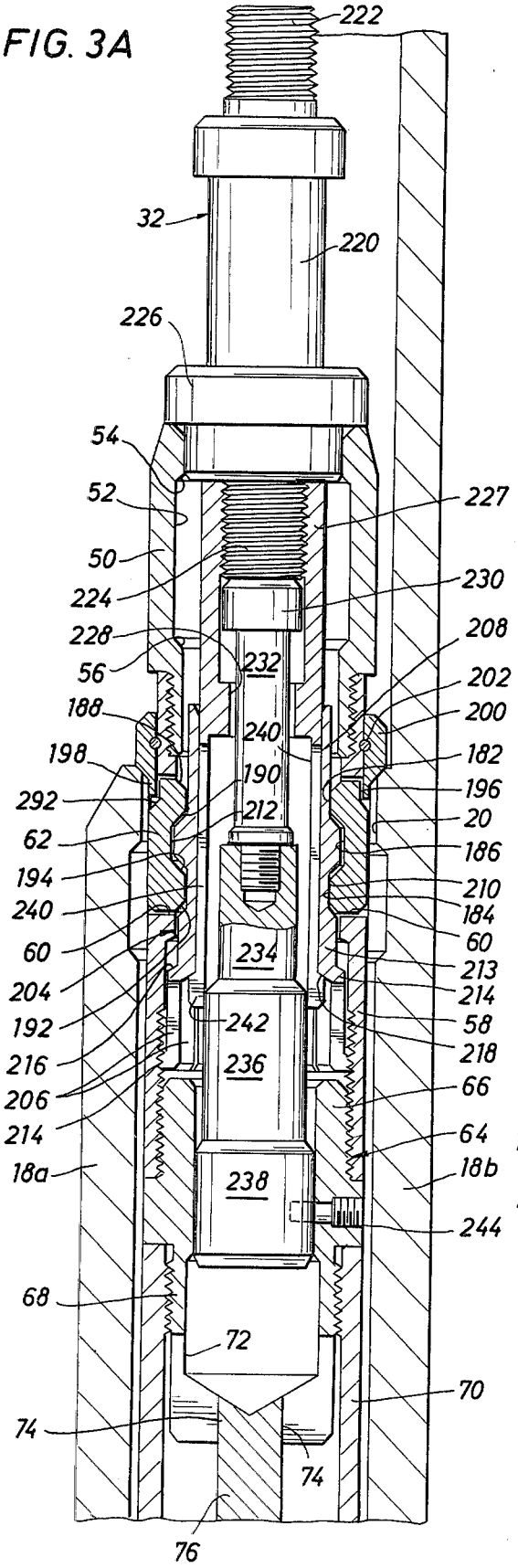
FIG. 3A is an enlarged longitudinal sectional view of the upper portion of the side pocket and gas lift valve and an attached running-in tool after insertion of the valve into the pocket, but before locking.

Referring first to FIGS. 1 and 2, there is shown a section of a well bore lined with a suitable casing 10. Disposed within casing 10 is the mandrel 12 of the present invention. As is well known in the art, mandrel 12 would be equipped with upper and lower threaded pins or boxes (not shown) whereby mandrel 12 would be connected into and form a part of a string of production tubing. The production tubing is suspended within the casing 10 so as to define an annulus 180 therebetween. Mandrel 12 is generally tubular, including a main longitudinal bore 14 therethrough. Mandrel 12 further includes pocket walls defining a longitudinally extending pocket 16 laterally offset from main bore 14. More specifically, pocket 16 has a laterally inner wall portion **18*a*, common with the walls defining main bore 14, and generally serving to divide main bore 14 from pocket 16, and a laterally outer wall 18*b* defining the remainder of the pocket and dividing it from annulus 180**.

Pocket 16 has an open upper end 20 through which a gas lift valve assembly 22 may be inserted. Additionally, inner pocket wall **18*a* has an elongate lateral port 24 therethrough which provides communication between pocket 16 and main bore 14 of the mandrel and serves as the primary outlet port of the pocket. On the opposite or laterally outer side of pocket 16 from wall 18*a*, wall 18*b* has a pair of shorter lateral ports 26 and 28 therethrough providing communication between pocket 16 and the exterior of the mandrel. Ports 26 and 28 are longitudinally spaced apart, with primary outlet port 24 being disposed longitudinaly therebetween, and serve as the inlet ports for the pocket. Pocket 16 also has an auxilliary outlet port 30 on the same side of the pocket as primary outlet port 24, i.e. through walls 18*a*. Port 30 is disposed adjacent the bottom of pocket 16 so that it is spaced longitudinally below the other three lateral ports 24, 26, and 28**.

Valve assembly 22 is run into the string of production tubing including mandrel 12 by any suitable running-in string or line. Valve assembly 22 is suspended at the lower end of such running-in string by a running-in tool 32 which also serves to actuate the lock means of the valve assembly to lock the latter in pocket 16 in a manner to be described more fully below. A conventional kickover tool, diagramatically indicated at 34, is secured to the upper end of running-in tool 32 and serves to laterally displace running-in tool 32 and valve assembly 22 from the center line of the production tubing so that the valve may be aligned with and inserted into pocket 16.

Pocket walls **18*a* and 18*b* are provided with a series of internal annular upsets disposed between various ones of the ports or openings of the pocket, and each of these upset areas is adapted to receive a respective annular seal assembly carried on valve assembly 22. More specifically, a lowermost upset 36 is disposed between auxilliary outlet port 30 and the lower inlet port 28 and receives a seal assembly 38. The next adjacent upset 40 is disposed between inlet 28 and primary outlet 24 and receives seal assembly 42. Upset 44 is disposed between primary outlet port 24 and upper inlet port 26 and receives seal assembly 46. Finally, upset 48 is disposed between upper inlet 26 and the open upper end 20 fo the pocket and receives seal assembly 49**.

Figure 3B:
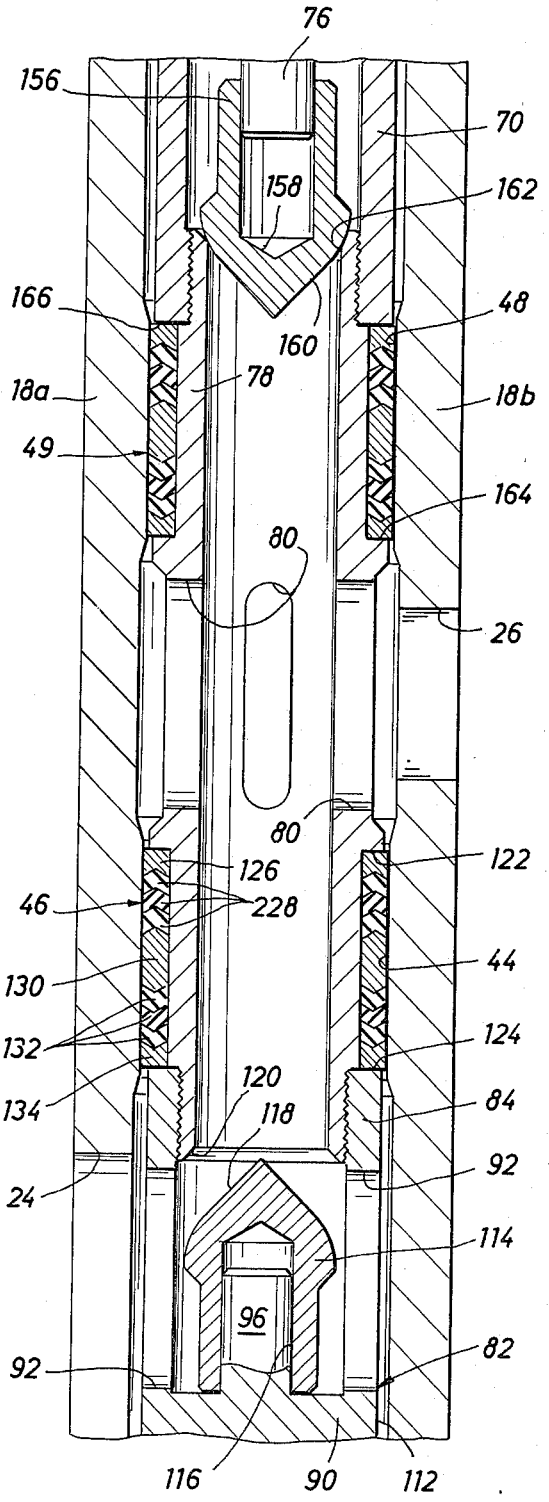
FIG. 3B is a continuation of FIG. 3A showing intermediate portions of the pocket and valve.
Figure 3C:
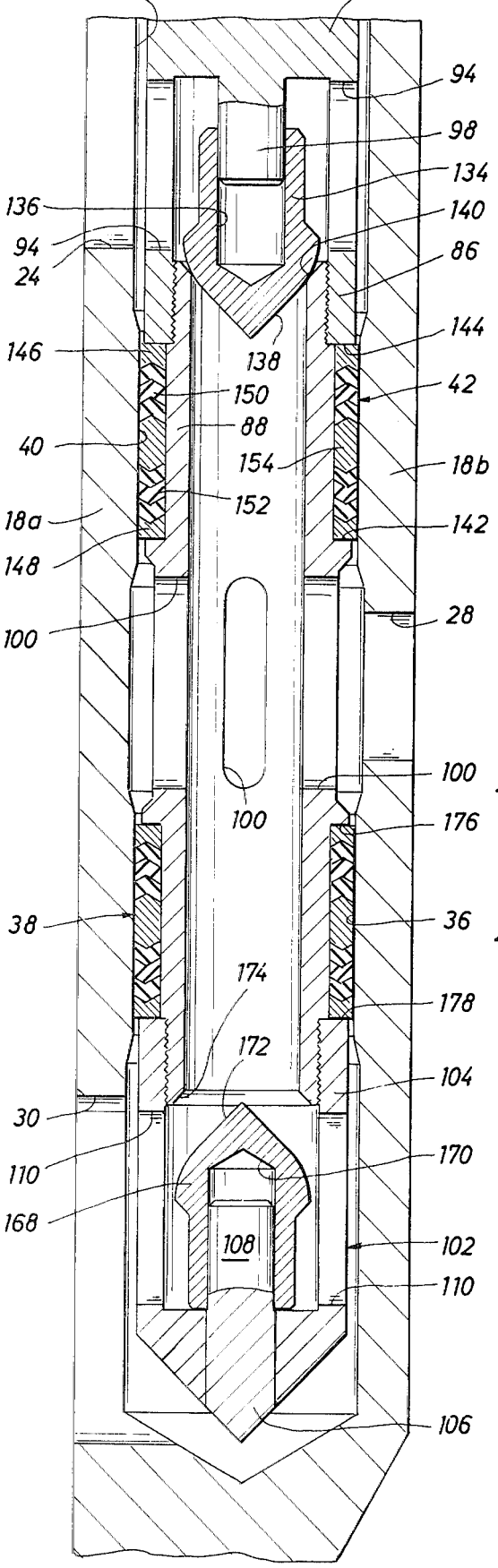
FIG. 3C is a continuation of FIG. 3B showing the lower portions of the pocket and valve.
Figure 4:
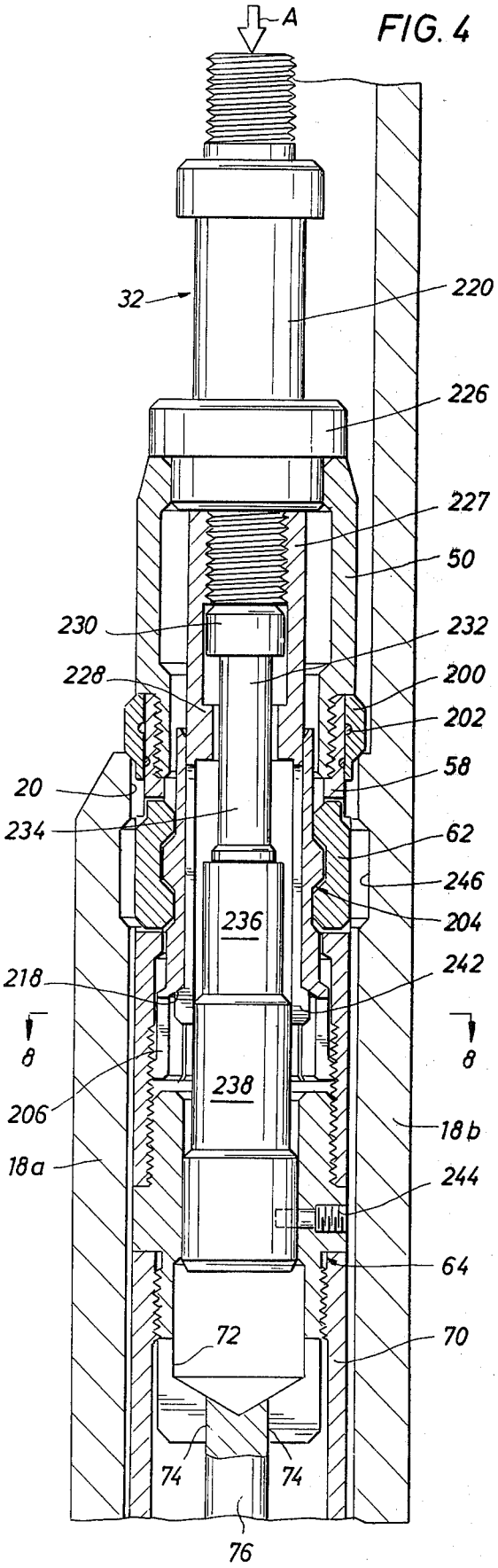
FIG. 4 is a view similar to that of FIG. 3A showing the relative positions of the parts during a first step in the locking operation.

Referring now to FIGS. 3A, 3B, and 3C, the parts of the valve assembly 22 will be described in greater detail. The valve assembly includes an elongate valve body on which the various other parts are carried. This valve body includes an upper generally tubular neck member 50. Neck member 50 has an internal annular counterbore 52 at the upper and lower ends of which are formed beveled shoulders 54 and 56 respectively. Threaded to the lower end of neck member 50 is a generally tubular cage 58. Cage 58 has a plurality of lateral openings or windows 60 therethrough in each of which is mounted a respective locking dog 62 which forms a part of the lock means for locking the valve body in a fixed position in pocket 16. Other parts of the lock means, to be described below, are mounted on or about cage 58.

The valve body further includes a connecting member 64 having upper and lower nipples 66 and 68. Nipple 66 is threaded into the lower end of cage 58, while nipple 68 is threaded into the upper end of a sleeve 70, also forming a part of the valve body. Member 64 also includes a cup-like formation 72 integral with and extending downwardly from connection 68. Cup-like formation 72 has a pair of lateral slits 74 therethrough permitting communication between the longitudinal bore defined by members 50, 58, 66, and 68 and the bore defined by sleeve 70 therebelow. A cylindrical rod 76 integral with cup formation 72 extends downwardly from the center of formation 72 into sleeve 70.

Threaded into the lower end of sleeve 70 is another sleeve 78 having four lateral openings 80 therethrough generally intermediate its ends. Openings 80 are spaced 90° from one another about sleeve 80. The lower end of sleeve 80 is threaded into a mounting member 82 which forms a further extension of the valve body. Member 82 has a recessed or generally tubular upper end 84 threaded to sleeve 78 and forming a continuation of the bore of sleeves 78 and 70. The lower portion 86 of member 82 is likewise recessed or tubular so as to form a continuation of the longitudinal bore defined by a sleeve 88 threaded into the lower end of portion 86 and also forming a part of the valve body. Between portions 84 and 86 of member 82 is a solid portion 90 which divides or separates the bores of portions 84 and 86. Member 82 has four circumferentially spaced apart lateral openings 92 through upper tubular portion 84 just above portion 90 and a similar set of four lateral openings 94 just below portion 90 through lower tubular portion 86. A cylindrical rod 96 integral with portion 90 of member 82 extends upwardly from portion 90 into the bore of portion 84. Likewise, a cylindrical rod 98 extends downwardly from portion 90 into the bore of portion 86.

As previously mentioned, a sleeve 88 is threaded into the lower end of portion 86 of member 82. Sleeve 88 is substantially identical to sleeve 78 and includes four circumferentially spaced lateral openings 100 therethrough generally intermediate its ends. Finally, the valve body includes a lower cup-like member 102 threaded to the lower end of sleeve 88. Member 102 has a generally tubular upper portion 104 forming a continuation of the bore of sleeves 88 and a lower wall 106 extending laterally across the valve body. A cylindrical rod 108 extends upwardly from the center of wall 106. Tubular portion 104 has four openings 110 therethrough adjacent wall 106.

It can be seen that the valve body previously described defines, cooperatively with pocket walls **18*a* and 18*b*, a flowway extending generally lengthwise of the pocket 16. The major portion of this flowway is formed by the various central longitudinal bores of the valve body. More specifically, the upper portion of the flowway is formed by the central longitudinal bores through members 50 and 58 and the upper portion of member 64. The flowway is continued through slits 74 to the central longitudinal bore defined by sleeves 70 and 80 and upper portion 84 of member 82. The flowway is continued through lateral openings 92, the annular space 112 defined between portion 90 of body 82 and pocket walls 18*a* and 18*b*, and lateral openings 94. Finally, the lowest portion of the flowway is defined by the central longitudinal bores of sleeve 88 and portion 104 of member 102**.

Each of the rods 76, 96, 98, and 108 of the valve body carries a respective valve member for longitudinal sliding movement thereon. Each of these valve elements is designed to open and/or close one or another of the central longitudinal bores through the valve body thereby permitting and/or preventing communication between a respective pair of various openings into and out of the aforementioned flowway. For example, rod 96 carries a valve element 114 which will be considered the first valve element of the assembly. Valve element 114 has an internal longitudinal recess 116 slidably receiving rod 96. The exterior of the end of element 114 adjacent the bottom of recess 116 is longitudinally and radially tapered as indicated at 118 to form a sealing surface for engagement with the opposed beveled lower end 120 of sleeve 78, which serves as the seat for element 114. It can be seen that, with valve element 114 disposed in its lowermost position, i.e. retracted on rod 96 so that it rests upon solid portion 90 of member 82, sealing surface 118 is spaced from seat 120 so that communication is permitted between lateral openings 92 and 94 and lateral openings 80 in the valve body via the longitudinal bores defined by sleeve 78 and portion 84 of body 82. However, if valve element 114 is extended along rod 96, i.e. upwardly, its sealing surface 118 may engage seat 120 thereby closing the last mentioned central longitudinal bore intermediate lateral openings 92 and 94 and lateral openings 80 thereby preventing communication therebetween.

FIGS. 3A, 3B, and 3C show valve assembly 22 after it has been run into pocket 16 and prior to locking therein. It can be seen, that in such position, lateral openings 80 are generally longitudinally aligned with inlet port 26 of the pocket, while lateral openings 92 and 94 are generally longitudinally aligned with the primary outlet port 24 of the pocket. Although the valve body shifts downwardly slightly from the position shown in FIGS. 3A–C during the locking procedure, as will be described more fully below, such shifting is so slight that, after the valve assembly is properly locked into the pocket, the inlet 26 and outlet 24 will still be generally aligned with the respective lateral openings of the valve body as described above. Accordingly, when valve element 114 is in its open position as shown in FIG. 3B, communication is permitted between the pocket inlet port 26 and the pocket outlet port 24 via lateral openings 80, 92, and 94, and the valve flowway therebetween.

Furthermore, seal assembly 46, which is carried on the exterior of sleeve 78 between a shoulder 112 formed thereon and opposed shoulder 124 defined by the upper end of portion 84 of body 82, seals between the exterior of the valve body and the interior of the pocket between lateral openings 80 and lateral openings 92 and 94. Seal assembly 46 includes a retainer ring 126 abutting shoulder 122 and a stack of chevron type seals 128 therebelow. The assembly further comprises a spacer ring 130 dividing the first stack of chevron rings 128 from a similar but oppositely directed stack of chevron rings 132. A second retainer ring 134 is disposed between chevron rings 132 and shoulder 124. Since chevron rings 128 and 132 are oppositely directed, the seal assembly 46 as a whole is capable of preventing fluid flow in either direction through the annulus formed between the valve body and the pocket walls 18*a* and 18*b* in the area of the seal assembly. Thus, if valve element 114 is moved upwardly to engage seat 120 as described above, pocket inlet port 26 is completely sealed from communication with pocket outlet port 24.

The second valve element of assembly 22 is element 134 which is identical to element 114 except that its orientation is reversed, i.e. it is slidably carried by the downwardly-extending rod 98 via a recess 136 opening upwardly to receive such rod, and its tapered sealing surface 138 faces downwardly so that it is opposed to and engageable with a beveled seat 140 formed on the upper end of sleeve 88. It can be seen that seat 140 is disposed between lateral openings 92 and 94, aligned with the pocket outlet port 24, and lateral openings 100, aligned with the lower of the pocket inlets 28. Accordingly, when valve element 134 is moved downwardly so that its sealing surface 138 engages seat 140 as shown in FIG. 3C, the central longitudinal bore of the valve body defined by sleeve 88 is closed between openings 92 and 94 and openings 100. On the other hand, if valve element 134 is urged upwardly, said bore will be opened so that communication between the two aforementioned sets of lateral openings in the valve body, and accordingly between pocket inlet 28 and pocket outlet 24, is permitted.

As previously noted, an annular seal assembly 42 is carried on the exterior of sleeve 88 between an upwardly-directed shoulder 142 formed thereon and an opposed downwardly-directed shoulder 144 formed by the lower end of member 82. Seal assembly 42 is substantially identical to seal assembly 46, and in particular, comprises retainer rings 146 and 148 at opposite ends thereof oppositely directed stacks of chevron rings 150 and 152, and a spacer ring 154 between the two stacks of chevron rings. Accordingly, assembly 42 is capable of sealing the annular area between sleeve 88 and pocket walls 18*a* and 18*b* against fluid flow in either longitudinal direction, so that when valve element is in its closed position as shown, communication between inlet 28 and outlet 24 is completely blocked.

As mentioned above, pocket 16 has an open upper end 20. It can be seen that, when running-in tool 32 is removed from valve assembly 22 (see FIG. 7), the uppermost or neck member 50 of the valve body also provides an open upper end therefor aligned or reigstering with the upper end of the pocket so that fluid flowing outwardly through neck 50 will be flowing out of pocket 16. It can also be seen that, when the running-in tool 32 is removed, the valve body generally has an open central longitudinal bore extending from the upper end of neck member 50 to slits 74 in cup-like member 72, and communicating via such slits with the central longitudinal bore of sleeve 70. A third valve element 156 serves to open and close the last mentioned bore intermediate the lateral openings 80, which are aligned with the uppermost pocket inlet 26, and the open upper end of the valve body. Valve element 156 is identical to valve element 134 in both structure and operation, and in particular, includes a central upwardly-directed recess 158 by which it is slidably mounted on rod 76 and a tapered sealing surface 160 opposed to and sealingly enagageable with a beveled surface 162 formed by the upper end of sleeve 78.

An annular seal assembly 49 is carried on the exterior of sleeve 78 between an upwardly facing shoulder 164 thereon and the opposed lower end of sleeve 70. Seal assembly 49 is identical to assemblies 42 and 46 described above and serves to seal the annulus between sleeve 78 and pocket walls 18*a* and 18*b* against fluid flow in either direction. Accordingly, when valve element 156 is in its lowermost position, i.e. with its sealing surface 160 engaging seat 162, lateral openings 80, and thus pocket inlet 26, are completely blocked from communication with the open upper end of the valve body. However, if element 156 is moved upwardly from the position shown in FIG. 3B, such communication is permitted.

Finally, a fourth valve element 168, identical to element 114, is provided for opening and closing the central longitudinal bore defined by sleeve 88 and member 102 between lateral openings 100 which are aligned with the lower of the pocket inlets 28, and lateral openings 110, which are in communication with auxilliary pocket outlet 30. Valve element 168 has a recess 170 by which it is slidably mounted on rod 108. Element 168 also includes a tapered sealing surface 172 opposed to and engageable with an annular beveled seat 174 formed on the lower end of sleeve 88. An annular seal assembly 38 is carried on the exterior of sleeve 88 between a downwardly-facing shoulder 176 formed on that sleeve and the opposed upwardly-facing end 178 of member 102. Seal assembly 38 is identical to assemblies 42, 46 and 49 described above and serves to seal the annulus between sleeve 88 and pocket walls 18*a* and 18*b* between lateral openings 100 and lateral openings 110. Accordingly, if valve element 168 is urged upwardly so that it engages seat 174, communication between openings 100 and 110, and thus between inlet 28 and outlet 30 is completely blocked. However, when valve element 168 is in its lowermost or open position as shown in FIG. 3C, such communication is permitted via the central longitudinal bore defined by sleeve 88 and member 102.

As noted, when valve assembly 22 is locked in proper position in pocket 16, its open upper end defined by neck 50 opens through the open upper end of the pocket providing an outlet. Lateral openings 80, are, at the same time, generally longitudinally aligned with the uppermost of the pocket inlets 26. Four of the openings 80 are provided so that, regardless of the orientation of the valve assembly in the pocket, one or the other of the openings 80 is likely to be at least partly in radial register or alignment with inlet 26 to facilitate flow of gas through inlet 26 and the adjacent one of the openings 80 into the valve flowway. Furthermore, the inner diameter of pocket 16 is enlarged in the area of inlet port 26, i.e. between seal-engagement upsets 44 and 48, to facilitate flow of fluid from port 26 through the annulus between pocket walls 18*a* and 18*b* and sleeve 78 and thence into the lateral openings 80 even if none of the latter openings are in register with the inlet port 26.

Similarly, openings 92 and 94 will be generally longitudinally aligned with the outlet ports 24 of the pockets, and in most cases, one of the openings 92 and one of the openings 94 will be at least partially in register with such outlet. In any event, the inner diameter of pocket walls 18*a* and 18*b* is enlarged in the area of outlet port 24 to facilitate flow of fluid from said port to openings 92 and 94 regardless of whether or not any of such openings are in register with the outlet port. Openings 100 will be generally longitudinally aligned with the lower inlet port 28 of the pocket, and the inner diameter of walls 18*a* and 18*b* is enlarged in the area of port 28 to facilitate flow of fluid therethrough into openings 100. The inner diameter of pocket walls 18*a* and 18*b* is also enlarged adjacent auxilliary outlet port 30 to facilitate flow of fluid from openings 110 to and through outlet 30.

The valve elements 114, 134, 156, and 168 are designed in accord with intended usage of valve assembly 22 as the lowermost such assembly in a string of production tubing. Accordingly, these valve elements are freely slidable on their respective rods so that they may be moved upwardly and/or downwardly by pressure differentials acting transversely thereacross. When valve assembly 22 is first emplaced in pocket 16 each valve element typically drops by gravity into its lowermost position so that, as shown in FIGS. 3A, 3B, and 3C, valve elements 156 and 134 are in their closed positions, while valve elements 114 and 168 are in their open positions. However, depending upon the down hole pressure and other conditions, valve elements 114 and 168 may also be in their closed positions. In any event, when the pressure head of a column of oil in the production tubing string of which mandrel 12 forms a part is so great that the oil will not flow upwardly under the force of the formation pressure, gas lifting may be performed by pumping a gas into the annulus 180 between the casing 10 and the production tubing.

Such gas will enter inlet ports 26 and 28 of pocket 16. Due to seal assemblies 38, 42, 46, and 50, such gas is prevented from flowing directly from inlet ports 26 and 28 longitudinally along the exterior of the valve body, but rather, is forced to enter aligned lateral openings 80 and 100 respectively in the valve body. Thus gas entering inlet port 26 is directed into the portion of the valve flowway formed by the central longitudinal bore defined by sleeve 78. From here, the gas flows both upwardly and downwardly moving valve element 156 into its open position so that gas may flow upwardly and out through the upper end of the valve body into main bore 14 of mandrel 12. Gas entering the gas flowway through inlet 26 and openings 80 also flows downwardly either moving valve element 114 into its open position or retaining it in that position so that such gas may flow outwardly into the main bore of the mandrel through lateral openings 92 and pocket outlet port 24.

Likewise, gas entering inlet port 28 flows through longitudinally aligned openings 100 into the portion of the valve flowway defined by the central longitudinal bore of sleeve 88. This gas flows upwardly urging valve element 134 into its open position whereby the gas may flow outwardly through lateral openings 94 and aligned pocket outlet port 24 into the main longitudinal bore 14 of mandrel 12. Gas entering through inlets 28 and openings 100 also flows downwardly moving valve element 168 to and/or retaining it in its opened position so that gas may flow around such valve element, through openings 110, and out through auxilliary outlet port 30 into main bore 14.

It can thus be seen that the single side pocket mandrel and valve of the invention provides two inlets from the annulus each of which is permitted to communicate with two different outlets into the main bore of the mandrel and thus into the column of oil in the production tubing. Accordingly, while occupying little more room than a conventional gas lift valve, the apparatus of the present invention can provide for many times the volumetric flow rate of gas of such valves. Also, such increased flow is accomplished without the need for the expense, awkwardness, and time consumption of prior multiple-valve systems.

It should be noted at this point that the type of valve element shown in the preferred embodiment is only one type of valve element which can be employed. In particular, valve elements similar to those shown could be used along with compression springs, disposed within the recesses of the valve elements, for biasing the valve elements into their closed positions so that a known gas pressure would be required to open them. Likewise, virtually any other type of gas lift valve elements could be employed along with any other modifications necessary to provide an appropriate seat for such element.

Turning now to FIGS. 3A and 4–9, the setting or actuation of the lock means by the running-in tool will be described. The lock means of the valve assembly, as previously mentioned, includes a plurality of locking dogs 62 disposed in windows 60 of cage 58 which forms a part of the valve body. The radially inner surface of each dog 62 includes upper and lower upset portions 182 and 184 respectively spaced apart by a recess 186. Each upset 182 is joined to the upper end surface of the respective dog by an upwardly and radially outwardly inclined surface 188 and to the recess 186 by a downwardly and radially outwardly inclined surface 190. Upset 184 is joined to the lower end surface of the dog by a downwardly and radially outwardly inclined surface 192 and to recess 186 by an upwardly and radially outwardly inclined surface 194.

The outer surface of each dog 62 is generally cylindrical having a cutaway portion 196 for receipt of a downwardly extending retaining flange 198 of a ring 200 secured to the exterior of cage 58 generally above dogs 62 by a shear ring 202. The outer surface of each dog also includes a downwardly and outwardly inclined section or bevel 292 at the bottom of cutaway section 196.

The lock assembly of the valve 22 further includes a retaining sleeve 204 disposed within cage 58 inwardly of dogs 62. Sleeve 204 includes a solid or continuous upper portion and a lower portion having circumferentially spaced apart collet fingers 206. The outer surface of the solid upper portion of sleeve 204 includes small diameter sections 208 and 210 which, in the running-in position shown in FIG. 3A receive upsets 182 and 184 respectively of dogs 62. Intermediate small diameter sections 208 and 210 is a large diameter section or upset 212 which extends radially outwardly into recesses 186 in the running-in position. Small diameter sections 208 and 210 are joined to upset 212 by longitudinally and radially inclined surfaces parallel to surfaces 190 and 194 of dogs 62. Section 210 is likewise joined to a larger diameter portion 212 therebelow by a downwardly and radially outwardly inclined surface parallel to surface 192 of the dogs. Accordingly, sleeve 204 meshes with dogs 62 in the running-in position shown in FIG. 3A.

At the lower end of portion 212 of sleeve 204 is a a radially outwardly extending flange 214 from which collet fingers 206 extend downwardly. Flange 214 defines both an upwardly facing shoulder 216 and a downwardly facing shoulder 218, both of which are downwardly and radially outwardly inclined. As described above, cage 58 is internally threaded to receive the upper nipple 66 of member 64. However, such internally threaded section of cage 58 is longer than nipple 66, and in particular, extends upwardly therefrom. The lower portions of collet fingers 206 are aligned with this threaded section of cage 58 in the running-in position. The lower end of each collet finger 206 has a radially outwardly turned foot 214 having teeth formed on its outer surface for ratchet-like engagement with the adjacent threaded section of cage 58.

Although running-in tool 32 does not form a part of the present invention per se, it will be briefly described for the purpose of illustrating the operation of the lock means of valve assembly 22. Tool 32 includes an upper or base member 220 on which the other parts of the tool are carried. Member 220 includes an upper pin 222 by which the tool may be connected to the kickover tool 34 thereabove, a lower pin 224, and a radially outwardly-extending flange 226 which engages the upper end of neck member 50 of the valve body. A collet 227 is threaded to lower pin 224. Collet 227 has an annular flange 228 extending inwardly therefrom and spaced below pin 224. Accordingly, the upwardly-facing end surface of flange 228 and the downwardly-facing end surface of pin 224 define opposed spaced-apart stop surfaces engageable with a head 230 mounted at the top of a rod 232 for limiting telescoping movement of rod 232 within collet 227. Affixed to the lower end of rod 232 are a series of cylindrical members 234, 236, and 238 of progressively increasing outer diameter.

The fingers 240 of collet 227 have radially outwardly-extending feet 242 at their lower or free ends. In running-in position, feet 242 underlie shoulders 218 defined by collet 204 of the valve assembly. This supports the entire valve assembly for running-in. The assembly consisting of head 230, rod 232, and cylinders 234, 236, and 238, is fixed in its uppermost position with respect to collet 227 by a shear pin 244 extending into member 64 of the valve body. This, together with rings 200 and 202, retains the upper end of cylindrical portion 236 in alignment with the lower ends of collet fingers 240 of the running-in tool thereby preventing these fingers from moving radially inwardly and thus maintaining support of the valve assembly on the running-in tool.

With the parts thus assembled, the running-in tool and valve assembly are lowered into the production tubing and laterally offset into alignment with pocket 16 by kickover tool 34. The valve assembly is then lowered into pocket 16 until ring 200 abuts the upper end of the pocket as shown in FIG. 3A. To lock the valve assembly in place, the operator first jars downwardly on tool 32 as indicated by arrow A in FIG. 4. This causes shearing of ring 202, allowing the entire running-in tool and valve assembly to move downwardly with respect to ring 200 thereby removing flange 198 from cutout portion 196 of dogs 62. This frees the dogs for potential movement radially outwardly into the internal annular recess 246 in the upper end of pocket 16, while the simultaneous downwardly movement of the tool places dogs 62 in proper alignment with such recess.

Figure 5:
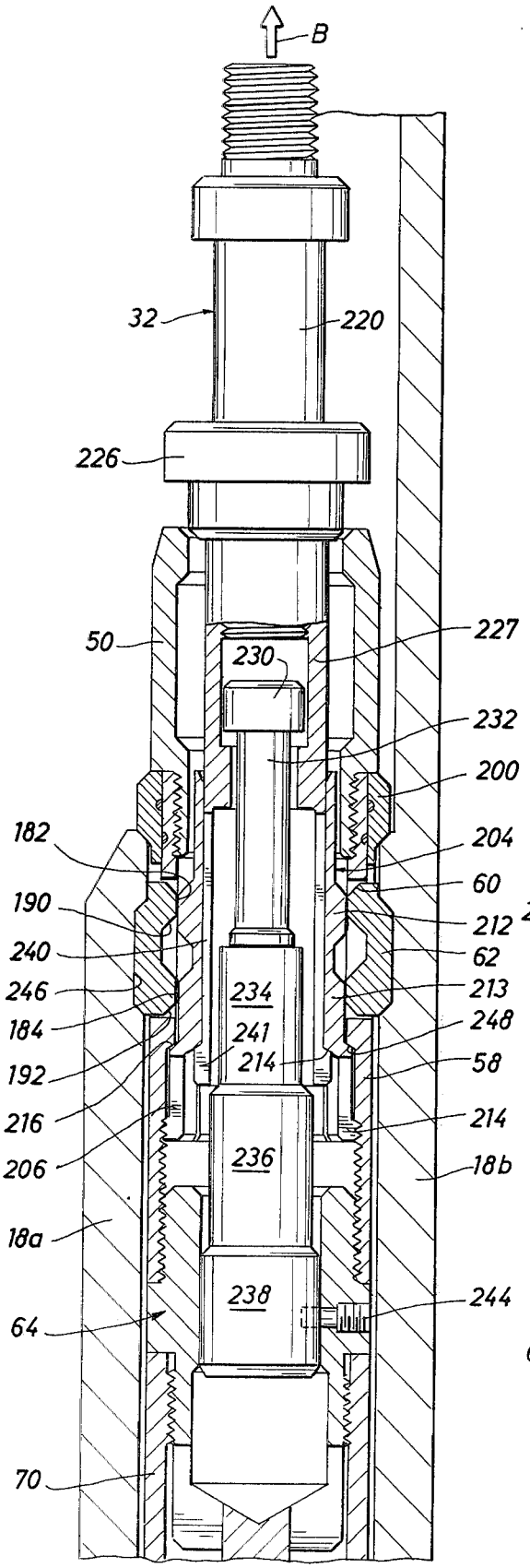
FIG. 5 is a view similar to that of FIG. 3A showing the relative positions of the parts during a second step in the locking operation.

In the next step of the locking operation, the operator pulls upwardly on tool 32, as indicated by arrow B in FIG. 5. In this step, collet 27 telescopes upwardly with respect to rod 232 carrying with it the sleeve 204 of the valve assembly. Since dogs 62 are prevented from moving upwardly by their engagement in windows 60 of cage 58, upward movement of sleeve 204 cams dogs 62 outwardly into recess 246 via inclined surfaces 192 and 190 of the dogs and the corresponding surfaces of sleeve 204. Upset 212 and large diameter portion 213 of sleeve 204 move into alignment with upset 182 and 184 respectively of dogs 62 to retain dogs 62 in their radially outer or extended positions in recess 246. Meanwhile, the collet fingers 206 of sleeve 204 will have ratcheted upwardly along the lower internal threads of cage 58, and the engagement of the teeth on the feet 214 of such collet fingers with these threads will resist longitudinal movement of sleeve 204 with respect to the valve body thereby releasably holding sleeve 204 in its retaining position with respect to dogs 62.

Figure 6:
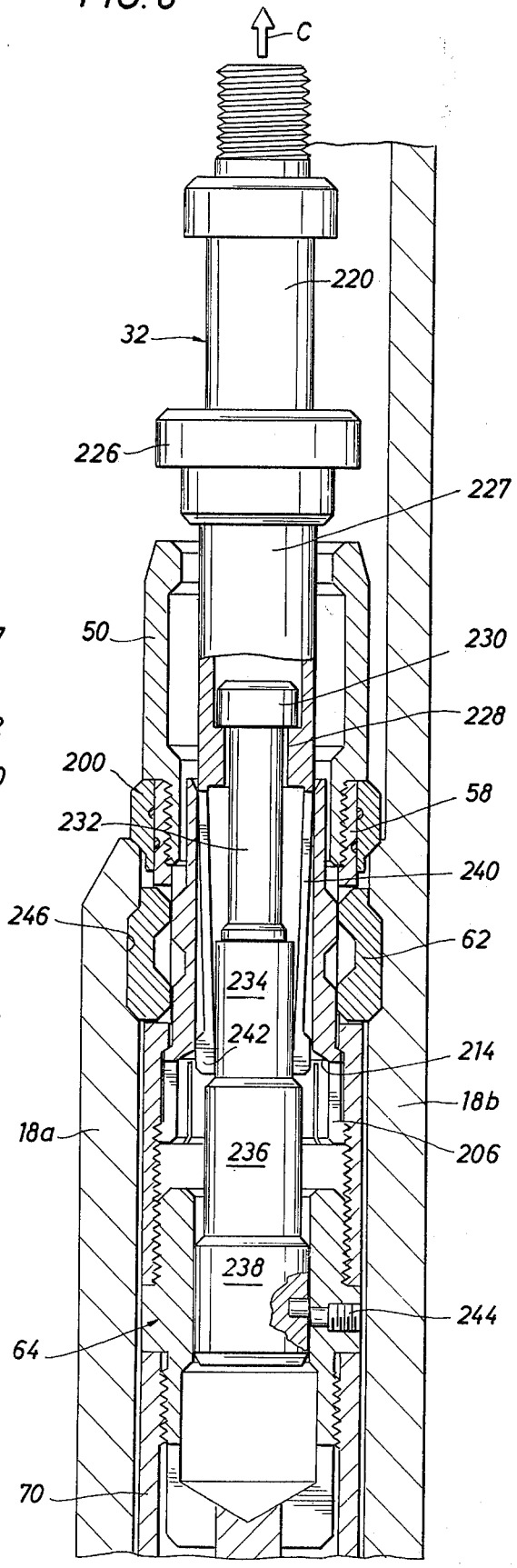
FIG. 6 is a view similar to that of FIG. 3A showing release and retreival of the running-in tool.
Figure 7:
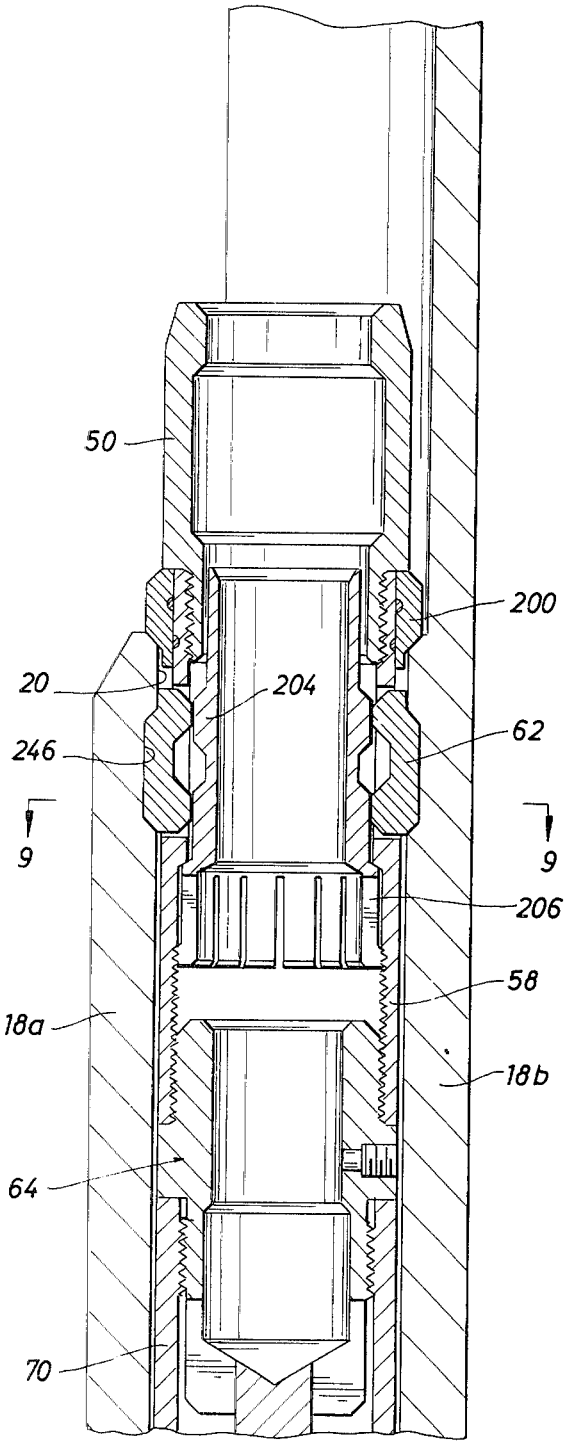
FIG. 7 is a view similar to that of FIG. 3A showing the valve locked into the pocket and the running-in tool removed.
Figure 8:
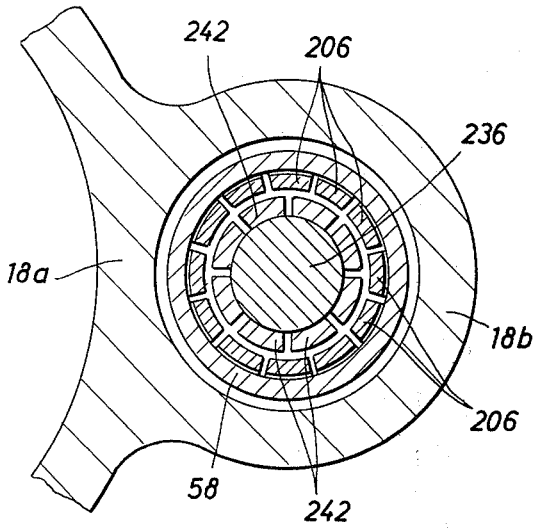
FIG. 8 is a transverse sectional view taken on the line 8—8 of FIG. 4.
Figure 9:
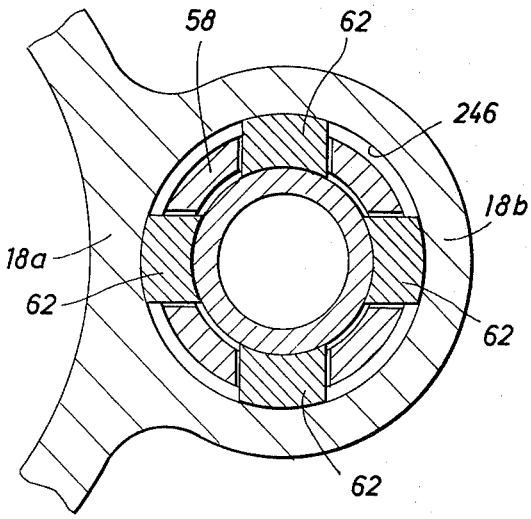
FIG. 9 is a transverse sectional view taken on the line 9—9 of FIG. 7.

It can also be seen that the upward movement of collet 227 removes its collet fingers 240 from a position of alignment with relatively large diameter section 236 and into alignment with the next smaller diameter section 234 of the appendage to rod 232. Thus, collet fingers 240 are now free to move radially inwardly. Since sleeve 204 is prevented from further upward movement when upwardly directed shoulder 216 comes into engagement with an opposed internal annular shoulder 248 on cage 58, further upward movement of collet 227 via the operating string will cause fingers 240 to be cammed radially inwardly by inclined shoulder 214 thus bringing feet 242 out of supporting engagement with sleeve 204 and the valve assembly in general as shown in FIG. 6. Finally, upon continued upward movement of tool 32, including collet 227, as indicated by arrow C in FIG. 6, flange 228 wil come into engagement with the underside of head 230 to begin an upward pull on assemblage 230, 232, 234, 236, and 238. This breaks shear pin 244 releasing the running-in tool 32 from the valve assembly and allowing the running-in tool to be removed therefrom as shown in FIG. 7.

Figure 10:
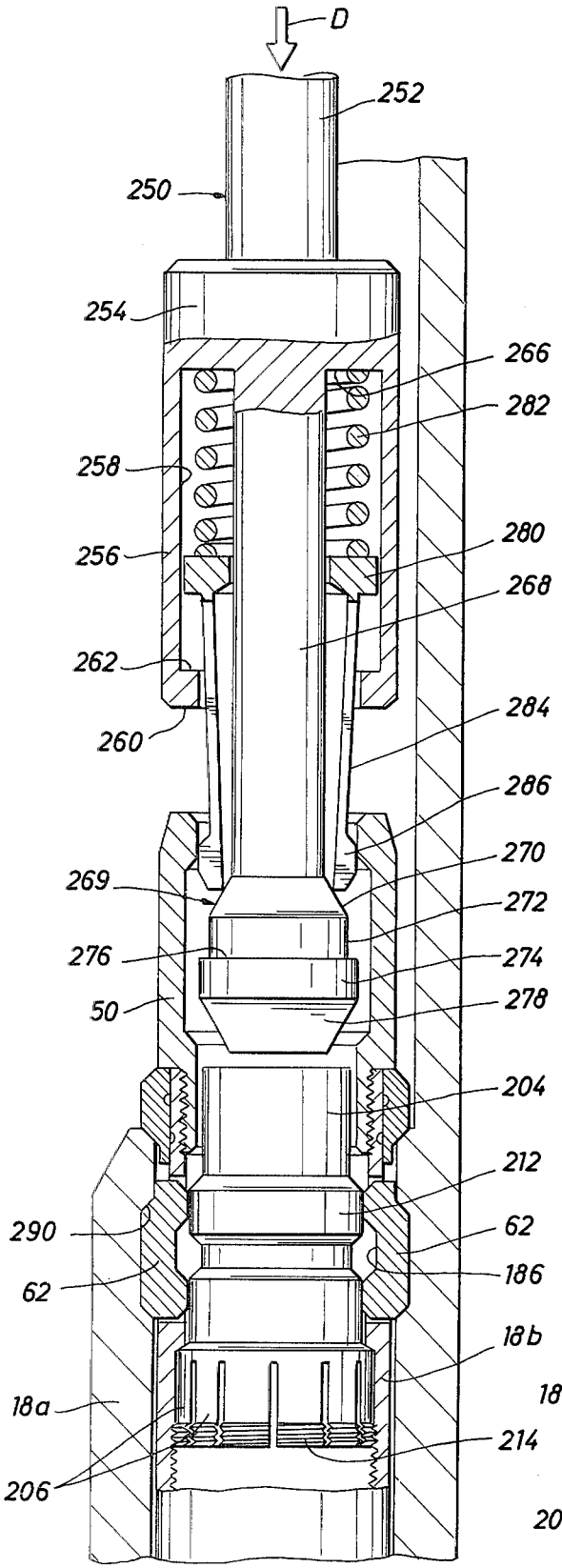
FIG. 10 is a view similar to that of FIG. 3A showing a retrieval tool being run into the valve.
Figure 11:
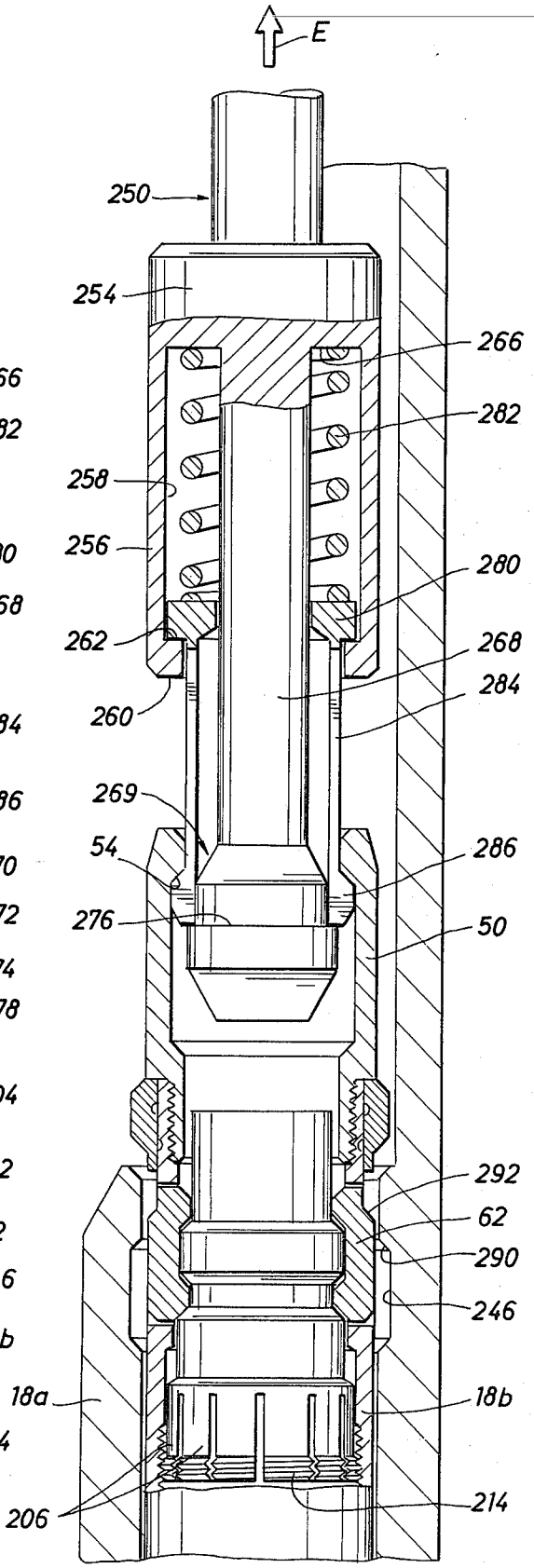
FIG. 11 is a view similar to that of FIG. 3A showing the retrieval tool engaged with the valve, and the valve released from and being removed from the pocket.

The valve is then operated as needed and as explained hereinabove by the application of gas pressure to the annulus 180 defined between the production tubing and the well casing. When the valve assembly is no longer needed, or at such time as it requires repair or service, the lock means thereof can be released and the valve retrieved from pocket 16. FIGS. 10 and 11 show only one of a number of retrieval tools which could be used for this purpose. Again, it should be understood that the retrieval tool forms no part of the present invention per se. The retrieval tool includes a main body 250 having an upwardly extending rod-like member 252 which may be provided with a threaded pin or box (not shown) for for attaching the tool to a suitable operating string, and more specifically, to a kickover tool. Extending radially outwardly from member 252 at its lower end is a head 254. Integral with and extending downwardly from the outer extremity of head 254 is a cylindrical wall 256 defining a chamber 258. At the lower end of wall 256 is a radially inwardly extending annular flange 260 defining an upwardly-directed stop surface 262 opposed to the downwardly-directed lower surface 264 of head 254. Also integral with head 254 is a rod 268 which extends downwardly through and beyond chamber 258. Rigidly secured to the lower end of rod 268 is a retainer member 269 having a conical upper section 270 flared downwardly and radially outwardly from rod 268. Below section 270 is a cylindrical section 272 at the lower end of which is an enlarged diameter portion 274 defining an upwardly-facing shoulder 276. Below section 274 body 269 has a tapered guide section 278. A collet 280 is mounted in chamber 258 for telescopic movement between shoulders 262 and 266. A compression spring 282 abuts the upper end of collet 280 to urge it downwardly within chamber 258. The fingers 284 of collet 280 are spring biased radially inwardly and have radially outwardly projecting feet 286 at their lower ends.

In operation, the retrieval tool is run into the production tubing and moved laterally into alignment with pocket 216 by a kickover tool. The tool is then urged downwardly with a sudden jarring action as indicated by arrow D in FIG. 10. This action causes member 269 to enter neck member 250 of the valve body and further causes member 269 to strike the upper end of sleeve 204 pushing it downwardly. Feet 214 of collet fingers 206 ratchet along the adjacent threaded section of cage 58 to permit such movement which brings upset 212 of sleeve 204 into alignment with recess 186 of dogs 62. During the downward jarring action, the feet 286 of collet 280 strike the upper end of neck 50 temporarily urging the collet upwardly against the bias of compression spring 282. This moves feet 286 generally into alignment with tapered section 270 of member 269 and/or with relatively small diameter rod 268 so that they may contract radially inwardly permitting member 269 to enter neck 50 followed by feet 286 of collet 280. Once these parts have entered the interior of neck 50, spring 282 will urge collet 280 downwardly until feet 286 are disposed radially outwardly of cylindrical section 272 and abutting upwardly-directed shoulder 276 of member 269. This holds the collet fingers 284 in a radially-extended position so that, upon subsequent upward movement of body 250, as indicated by arrow E in FIG. 11, feet 286 will be brought into abutment with the underside of shoulder 54 on neck 50 for supporting and moving upwardly the entire valve assembly 22. As cage 58 thus begins to move upwardly, and since dogs are constrained by windows 60 to move longitudinally therewith, radially outwardly and downwardly inclined upper end surface 290 of recess 246 will cam dogs 62 inwardly via opposed and similarly inclined surfaces 292 formed on the dogs themselves. Thus the lock means is released and the tool can be withdrawn from the pocket 16 and from the production tubing in general.

Various other types of running-in and/or retrieval tools can be used with the valve assembly of the present invention, and in particular, can be designed to actuate its lock means. Likewise, numerous modifications can be made in the pocket and/or the valve assembly themselves. Modifications of the valve elements have been discussed above. Likewise, modifications in the form and/or location of the various ports and openings could be made. For example, in the embodiment shown, the pocket walls are adapted for gas lift operations in which gas is pumped into the annulus between the well casing and the production tubing and admitted by the gas lift valve into a column of oil in the production tubing. However, for gas lift operations in situations in which the oil is disposed in the annulus, the inlet and outlet ports of the pocket could be generally reversed, i.e., the inlet ports disposed in wall 18*a* and the outlet ports disposed in wall 18*b*, to permit such operation. Modification for such reverse operations might also call for alteration of the upper and lower portions of the valve assembly containing the third and fourth valve elements. Numerous other modifications will suggest themselves to those of skill in the art. Accordingly, it is intended that the present invention be limited only by the claims which follow.

I claim:

1. Gas lift apparatus comprising:

a generally tubular mandrel defining a main longitudinal bore therethrough and including pocket wall means defining a longitudinally extending pocket laterally offset from said main bore and generally divided therefrom, said pocket having an open upper end;

said pocket wall means further having first port means extending laterally therethrough between said pocket and said main bore, and second port means extending laterally through said pocket wall means between said pocket and the exterior of said mandrel, one of said first or second port means including a pair of longitudinally spaced inlet ports, and the other of said first or second port means including a primary outlet port disposed longitudinally between said inlet ports and an auxiliary outlet port spaced below said primary outlet port and also below the lower of said pair of inlet ports;

and a valve assembly adapted to be received in said pocket, and when so received, operable to permit communication between both outlet ports of said other port means and at least the lower of the inlet ports of said one port means.

2. The apparatus of claim 1 wherein said one port means is said second port means, and said other port means is said first port means.

3. The apparatus of claim 2 wherein said valve means permits communication between both of said inlet ports and said primary outlet port.

4. The apparatus of claim 2 wherein said valve assembly includes a valve body having central longitudinal bore means at least partially defining a flowway extending generally lengthwise of said pocket; lock means cooperating between said valve body and said pocket wall means to lock said valve body in a fixed position within said pocket; said valve body having a first lateral opening therethrough from said bore means positioned to communicate with the uppermost of said pair of inlet ports when said valve body is in said fixed position, a second lateral opening therethrough from said bore means positioned to communicate with the lower of said pair of inlet ports when said valve body is in said fixed position, and a third lateral opening therethrough from said bore means positioned to communicate with said primary outlet port when said valve body is in said fixed position; a first valve element movably mounted on said valve body for opening and closing said bore means between said first and third lateral openings; and a second valve element movably mounted on said valve body for opening and closing said bore means between said second and third lateral openings.

5. The apparatus of claim 4 wherein said valve assembly further comprises first annular seal means for sealing between said valve body and said pocket wall means between said first and third lateral openings, and second annular seal means for sealing between said valve body and said pocket wall means between said second and third lateral openings.

6. The apparatus of claim 5 wherein said valve elements are adapted to be moved to and retained in open positions by fluid pressure applied through said inlet ports.

7. The apparatus of claim 6 wherein said valve body has an open upper end registering with the upper end of said pocket, said valve assembly further including a third valve element movably mounted on said valve body for opening and closing said bore means between said first lateral opening and said open upper end of said valve body, and third annular seal means for sealing between said valve body and said pocket wall means between said first lateral opening and said upper end of said valve body.

8. The apparatus of claim 2 wherein said valve body has an auxiliary opening therethrough from said bore means positioned to communicate with said auxiliary outlet port when said valve body is in said fixed position, said valve assembly further comprising a fourth valve element movably mounted on said valve body for opening and closing said bore means between said second lateral opening and said auxiliary opening, and fourth annular seal means for sealing between said valve body and said pocket wall means between said second lateral opening and said auxiliary opening.

9. The apparatus of claim 5 wherein said pocket wall means defines lateral recess means within said pocket, and said lock means includes at least one locking element carried by said valve body and radially extendable into said lateral recess means.

10. The apparatus of claim 9 wherein said lock means further comprises retaining means cooperative between said valve body and said locking element for retaining said locking element in a radially extended position.

11. The apparatus of claim 10 wherein said retaining means is releaseable to permit radial retraction of said locking element from said recess means and removal of said valve assembly from said pocket.

12. Gas lift apparatus comprising:

a generally tubular mandrel defining a main longitudinal bore therethrough and including pocket wall means defining a longitudinally extending pocket laterally offset from said main bore and generally divided therefrom, said pocket having an open upper end;

said pocket wall means further having first and second longitudinally spaced apart ports extending laterally through said pocket wall means between said pocket and the exterior of said mandrel, and a third port extending laterally through said pocket wall means between said pocket and said main bore and disposed generally intermediate said first and second ports;

and a valve assembly adapted to be received in said pocket, and when so received, operable to permit communication of each of said first and second ports with said third port.

13. A gas lift valve assembly including a valve body having central longitudinal bore means, said valve body having a first lateral opening therethrough from said bore means, a second lateral opening therethrough from said bore means and longitudinally spaced from said first lateral opening, and a third lateral opening therethrough from said bore means disposed longitudinally between but spaced from said first and second lateral openings;

a first valve element movably mounted on said valve body for opening and closing said bore means between said first and third lateral openings; and a second valve element movably mounted on said valve body for opening and closing said bore means between said second and third lateral openings.

14. The valve assembly of claim 13 further comprising lock means carried by said valve body for locking said valve body in a fixed position within a chamber.

15. The valve assembly of claim 13 further comprising first annular seal means externally surrounding said valve body between said first and third lateral opening and second annular seal means surrounding said valve body between said second and third lateral openings.

16. The valve assembly of claim 13 wherein said valve elements are adapted to be moved to and retained in open positions by fluid pressure applied through said first and third lateral openings.

17. The valve assembly of claim 13 wherein said valve body has an open upper end, said valve assembly further including a third valve element movably mounted on said valve body for opening and closing said bore means between said first lateral opening and said upper end of said valve body.

18. The valve assembly of claim 13 wherein said valve body has an auxilliary opening therethrough from said bore means and spaced below said lateral openings, said valve assembly further comprising a fourth valve element movably mounted on said valve body for opening and closing said bore means between said third lateral opening and said auxilliary opening.

* * * * *